US008988005B2

(12) United States Patent
Jungwirth et al.

(10) Patent No.: US 8,988,005 B2
(45) Date of Patent: Mar. 24, 2015

(54) ILLUMINATION CONTROL THROUGH SELECTIVE ACTIVATION AND DE-ACTIVATION OF LIGHTING ELEMENTS

(75) Inventors: Paul Jungwirth, Burnaby (CA); Ian Ashdown, West Vancouver (CA); Michael Albert Tischler, Scottsdale, AZ (US)

(73) Assignee: Cooledge Lighting Inc., Burnaby (CA)

( * ) Notice: Subject to any disclaimer, the term of this patent is extended or adjusted under 35 U.S.C. 154(b) by 270 days.

(21) Appl. No.: 13/398,316

(22) Filed: Feb. 16, 2012

(65) Prior Publication Data

US 2012/0212138 A1 Aug. 23, 2012

Related U.S. Application Data

(60) Provisional application No. 61/443,947, filed on Feb. 17, 2011, provisional application No. 61/502,970, filed on Jun. 30, 2011.

(51) Int. Cl.
*H05B 37/02* (2006.01)
*H05B 33/08* (2006.01)

(52) U.S. Cl.
CPC ..... *H05B 33/0824* (2013.01)
USPC ..... 315/307; 315/122; 315/312

(58) Field of Classification Search
USPC ..... 315/122, 185 R, 186, 187, 192, 193, 315/291, 307, 308, 312, 360
See application file for complete search history.

(56) References Cited

U.S. PATENT DOCUMENTS

| | | | |
|---|---|---|---|
| 6,072,280 | A | 6/2000 | Allen |
| 6,461,019 | B1 | 10/2002 | Allen |
| 6,621,235 | B2 | 9/2003 | Chang |
| 6,777,891 | B2 | 8/2004 | Lys et al. |
| 6,830,358 | B2 | 12/2004 | Allen |
| 7,210,957 | B2 | 5/2007 | Mrakovich |
| 7,250,730 | B1 | 7/2007 | Allen |
| 7,293,896 | B2 | 11/2007 | Cheung |
| 7,334,918 | B2 | 2/2008 | Newton et al. |
| 7,344,275 | B2 | 3/2008 | Allen et al. |
| 7,423,387 | B2 | 9/2008 | Robinson et al. |
| 7,524,097 | B2 | 4/2009 | Turnbull et al. |
| 7,645,053 | B2 | 1/2010 | Machi et al. |
| 7,646,029 | B2 | 1/2010 | Mueller et al. |
| 7,649,326 | B2 | 1/2010 | Johnson et al. |
| 7,723,926 | B2 | 5/2010 | Mednik et al. |
| 7,733,034 | B2 | 6/2010 | Kotikalapoodi et al. |
| 7,781,979 | B2 | 8/2010 | Lys |
| 7,821,023 | B2 | 10/2010 | Yuan et al. |
| 7,843,150 | B2 | 11/2010 | Wang et al. |
| 7,859,196 | B2 | 12/2010 | Lee et al. |
| 7,923,943 | B2 | 4/2011 | Peker et al. |
| 7,936,135 | B2 | 5/2011 | Hum et al. |
| 7,976,196 | B2 | 7/2011 | Ivey et al. |
| 8,008,864 | B2 | 8/2011 | Nguyen et al. |

(Continued)

FOREIGN PATENT DOCUMENTS

| | | |
|---|---|---|
| CN | 201225541 | 4/2009 |
| EP | 0734082 | 9/1996 |

(Continued)

*Primary Examiner* — Tung X Le
(74) *Attorney, Agent, or Firm* — Morgan, Lewis & Bockius LLP

(57) ABSTRACT

In various embodiments, an illumination system includes multiple light-emitting strings that are selectively activated or deactivated to regulate an overall output of the array.

58 Claims, 7 Drawing Sheets

(56) References Cited

U.S. PATENT DOCUMENTS

| | | | | |
|---|---|---|---|---|
| 8,022,634 | B2 | 9/2011 | Greenfeld | |
| 8,022,641 | B2 | 9/2011 | Janik et al. | |
| 8,049,439 | B2 | 11/2011 | Zhao et al. | |
| 8,193,739 | B2 * | 6/2012 | Kimura | 315/307 |
| 2004/0052076 | A1 | 3/2004 | Mueller et al. | |
| 2006/0001381 | A1 | 1/2006 | Robinson et al. | |
| 2006/0007013 | A1 | 1/2006 | Singer et al. | |
| 2006/0146553 | A1 | 7/2006 | Zeng et al. | |
| 2006/0244396 | A1 | 11/2006 | Bucur | |
| 2008/0018261 | A1 | 1/2008 | Kastner | |
| 2008/0224025 | A1 * | 9/2008 | Lyons et al. | 250/205 |
| 2009/0051629 | A1 | 2/2009 | Price et al. | |
| 2009/0079363 | A1 | 3/2009 | Ghoman et al. | |
| 2009/0079398 | A1 | 3/2009 | Saar | |
| 2009/0187925 | A1 | 7/2009 | Hu et al. | |
| 2009/0225020 | A1 | 9/2009 | Ran et al. | |
| 2009/0315471 | A1 | 12/2009 | Rowland | |
| 2010/0181923 | A1 | 7/2010 | Hoogzaad | |
| 2010/0289428 | A1 | 11/2010 | Frazier et al. | |
| 2010/0315012 | A1 | 12/2010 | Kim et al. | |
| 2011/0068700 | A1 | 3/2011 | Fan | |
| 2011/0109228 | A1 | 5/2011 | Shimomura et al. | |
| 2011/0109247 | A1 | 5/2011 | Hoogzaad et al. | |
| 2011/0140621 | A1 | 6/2011 | Yi et al. | |
| 2011/0163682 | A1 * | 7/2011 | Jungwirth | 315/192 |
| 2011/0164069 | A1 * | 7/2011 | Thompson et al. | 345/690 |
| 2011/0175550 | A1 | 7/2011 | Lin et al. | |
| 2011/0227493 | A1 | 9/2011 | Du et al. | |
| 2012/0306389 | A1 * | 12/2012 | Shteynberg et al. | 315/186 |
| 2012/0326613 | A1 * | 12/2012 | Liu | 315/185 R |

FOREIGN PATENT DOCUMENTS

| | | |
|---|---|---|
| WO | WO-03/015476 | 2/2003 |
| WO | WO-2009/137115 | 11/2009 |
| WO | WO-2010/074879 | 7/2010 |
| WO | WO-2010/151600 | 12/2010 |
| WO | WO-2011/002280 | 1/2011 |

* cited by examiner

ILLUMINATION CONTROL THROUGH SELECTIVE ACTIVATION AND DE-ACTIVATION OF LIGHTING ELEMENTS

RELATED APPLICATIONS

This application claims the benefit of and priority to U.S. Provisional Patent Application No. 61/443,947, filed Feb. 17, 2011, and U.S. Provisional Patent Application No. 61/502,970, filed Jun. 30, 2011, the entire disclosure of each of which is hereby incorporated herein by reference.

TECHNICAL FIELD

In various embodiments, the present invention relates generally to light-emitting systems and methods, and more specifically to such systems and methods that provide control over various lighting parameters in systems organized as strings of light-emitting elements.

BACKGROUND

The ability to choose a specific light output setting of an illumination system is desirable in many applications ranging from indicator lights, displays, optical communication systems, and lighting applications in general. For example, reducing the light intensity or turning off a portion or all of the lights in an illumination system is a very effective method to reduce power consumption. It is common practice, for example, to dim or de-energize the light-emitting elements when an office space is unoccupied or there is a change in ambient illumination due to daylight ingress in order to save energy. It is also common practice to dim or de-energize the light-emitting elements when the use requirements of an occupied space changes, such as, for example, when video projectors are used in an office space. In addition, it has recently become practical through the advent of solid-state lighting to change the color temperature and, more generally, the chromaticity of the light-emitting elements to mimic the changes in color temperature of natural daylight and so synchronize the circadian rhythms of night-shift workers.

In some applications, the light level may be controlled manually, semi-automatically or automatically through various controls and sensors. Illumination systems may also be controlled to provide multiple colors, or to change colors. For example, a multi-color light-emitting diode (LED) illumination system can transition through dozens of brightness and color combinations; they are commonly used in architectural, restaurant, commercial, mood lighting, decoration, parties, or special lighting environments. Being able to select an individual color, brightness level, and/or the light intensity distribution of an illumination system allows users to save energy as well as to match the light output with the environmental situation and design requirements.

The current-voltage characteristics ("I-V curve") of semiconductor LEDs are such that the forward voltage $V_F$ across the device remains relatively constant (e.g., within about 0.5V) within the device's normal operating range (FIG. 1). Consequently, the luminous flux output of the device can be controlled by varying the current flow (the "drive current") through the device by means of a constant-voltage power supply and a variable resistance connected in series with the LED, or by means of a constant-current power supply connected directly to the LED.

Currently, achieving a target illumination level from (e.g., dimming) LEDs may be accomplished by controlling the forward current flowing through the LEDs. Two common methods are analog dimming and pulse modulation dimming. Typically, analog dimming uses a variable resistor or a current regulator circuit to dynamically adjust current flowing through the LEDs and thus change the brightness thereof. This approach has a number of disadvantages. First, the current-voltage characteristics of individual semiconductor LEDs may vary, even within a single manufacturing batch. This may result in two LEDs generating different luminous flux outputs for the same drive current, particularly when the drive current approaches the "knee" of the I-V curve (FIG. 1). This may be problematic when the LEDs are electrically connected in series and mounted as an array on a common circuit board, particularly when the LEDs are directly visible to the viewer. Second, when the current is varied, not only is the light output power of the LED changed, but so, undesirably, are the color characteristics. This is problematic for general illumination applications, which typically mandate strict limits on any variations in lamp chromaticity. Depending on the circuitry involved, the efficiency and power factor may vary with different dimming levels, which is also undesirable. Third, blue- and green-emitting indium-gallium-nitride (InGaN) LEDs exhibit a secondary emission mechanism that tends to generate yellow light at low drive currents. This limits the dynamic range of drive currents for InGaN LEDs to approximately 100:1 before the change in perceived chromaticity become unacceptable. For general illumination applications, this dynamic range limitation is exacerbated by the nonlinear response of the human visual system, which perceives changes in perceived brightness according to the square root of light source intensity. Hence, while a 50:1 change in drive current may result in a 50:1 change in light source intensity using analog dimming, the change in perceived brightness is only 7:1. Architectural lighting dimming systems often require a greater dynamic range, which makes analog dimming unsuitable for such applications.

Additionally, when series-connected strings of LEDs are dimmed in this way, the method can fail due to the manufacturing variability in the electrical and optical characteristics of LEDs. For example, as the current is reduced, some LEDs turn off before others and some are dim when others are still quite bright. Finally, the use of analog dimming technology tends to increase the overall system power consumption since the analog dimming driver is always active.

Pulse modulation techniques (such as pulse width modulation (PWM) pulse code modulation (PCM) and pulse position modulation (PPM)) dimming techniques utilize a digitally modulated pulse to switch the LEDs on and off at a high frequency (ranging from about 300 Hz to over 100 kHz); the human visual system is typically incapable of perceiving such rapid changes for switching frequencies above 150 Hz, and so perceives the light source intensity as being the average on-time of the digitally switched drive current (FIG. 2). The longer the "on" periods are relative to the "off" periods, the brighter the LEDs will appear to the observer. In this approach the current level is fixed; it could be fixed at any value, but is often fixed at the maximum recommended current for the device, or at a value that provides an acceptable compromise between light output and efficacy). This approach is generally called pulse width modulation (PWM) and is frequently used to dim LED illumination systems.

The advantage of digital dimming in comparison to analog dimming is that the problems related to low drive current are eliminated. However, digital dimming control systems suffer from their own disadvantages. First, they require more complex circuitry than those used for analog dimming, which results in more expensive systems. This is especially true where the digital dimming controller must be capable of interfacing with a phase-cut dimmer control switch designed for incandescent lamp dimming, as additional circuitry is required to translate the AC phase information to the modulated current. It is difficult to design and expensive to manufacture digital dimming control systems that do not exhibit flicker and hysteresis at low light level settings when interfaced with phase-cut dimmer control switches.

Second, efficiency and power factor are often a function of the dimming level, with reduced efficiency and power factor typically occurring at low dimming levels. Third, PWM systems can generate high-frequency electrical noise that can interfere with or disrupt other electronic systems. Without careful design and expensive shielding, such noise may be transmitted into the AC power line and/or emitted as electromagnetic radiation that may potentially exceed allowable limits on radio frequency interference. This electrical interence may interfere with or disrupt other electronic systems such as power line modems and RF-enabled devices.

There is a need, therefore, for solutions that provide dimming control for LED illumination systems to achieve high efficiency and high power factor over the full range of dimmer settings, and providing freedom from undesirable chromaticity shifts and electrical noise and as well as permitting control of illumination characteristics such as color and light distribution.

SUMMARY

In various embodiments, the present invention relates to control of light-emitting systems including or consisting essentially of arrays of light-emitting elements (LEEs), e.g., a luminaire providing illumination for an architectural space. Such a lighting system typically includes multiple strings each including or consisting essentially of a combination of one or more LEEs electrically connected in series, in parallel, or in a series-parallel combination with optional fuses, antifuses, current-limiting resistors, zener diodes, transistors, and other electronic components to protect the LEEs from electrical fault conditions and limit or control the current flow through individual LEEs or electrically-connected combinations thereof. In general, such combinations include an electrical string that has at least two electrical connections for the application of DC or AC power. A string may also include or consist essentially of a combination of one or more LEEs electrically connected in series, in parallel, or in a series-parallel combination of LEEs without additional electronic components.

In the case of systems involving relatively large numbers of LEEs, it is possible to change the overall lighting effect by patterning the position of the LEE strings. For example, a parameter such as intensity level may be changed in a largely imperceptible fashion by selectively activating and deactivating groups of LEEs in particular patterns. Patterns may include positioning of the LEEs in, for example, pseudo-random patterns, or the use of other algorithms to affect parameters in order to create a desired lighting effect.

One factor favoring use of LED-based illumination systems is the associated energy savings over, for example, incandescent lighting systems. Whereas incandescent lamps have luminous efficacies on the order of 10 lm/W, LED-based systems can have luminous efficacies on the order of about 40 lm/W or higher, for example, over 70 lm/W. Additional energy savings can be achieved by reducing the overall light intensity, or turning the system off, when this is acceptable. In "daylight harvesting," light intensity is reduced when ambient light (e.g., from the sun) is present, thus keeping the overall light level at the desired value but reducing the amount of energy used. In an occupancy-sensing system, light intensity is locally dimmed or the system turned off completely when no people are present in order to save energy. The approach of the present invention may be used to implement such energy-saving techniques.

In various embodiments, the present invention relates to control of light-emitting systems and methods for limiting the energy used by these systems as well as controlling light intensities, light chromaticities, and/or light intensity distributions of light-emitting systems. (As used herein, the term "light" refers not only to the visible portion of the spectrum, but to any electromagnetic radiation.) A simple selective activation or deactivation of groups of the light-emitting elements is used to turn off portions of the array to save energy and/or to regulate a lighting parameter such as light intensity, intensity distribution, and/or chromaticity or other lighting parameters.

The lighting parameter may be varied in a perceptually smooth manner. Applying individual phosphors to each grouping of LEDs and mixing the output light of different groupings with different phosphors, or simply switching on or off groups of light-emitting elements that emit light of different chromaticities, may generate a desired overall chromaticity and achieve high luminous efficacy. Lenses with different optical characteristics may be associated with groups of the light-emitting elements to produce different light intensity distributions by switching groups of light-emitting elements associated with lenses with different optical characteristics off and on. Embodiments of the present invention permit real-time changes in one or more lighting parameters, e.g., upon detecting an environmental condition or an issued command from users or other control systems.

Accordingly, in an aspect, embodiments of the invention pertain to an illumination system including or consisting essentially of a light-emitting array including or consisting essentially of a plurality of light-emitting strings, at least one power source for providing power to the light-emitting strings, and a controller for selectively activating or deactivating various ones of the light-emitting strings to regulate an overall output of the array, e.g., to achieve a target value (i.e., a single value or range of values) of a lighting parameter. Each light-emitting string includes or consists essentially of a plurality of light-emitting elements electrically connected in series.

Embodiments of the invention may include one or more of the following in any of a variety of combinations. The light-emitting array may include or consist essentially of (i) a first group of one or more light-emitting strings, and, associated therewith, at least one first lens having a first optical characteristic, and/or (ii) a second group of one or more light-emitting strings, and, associated therewith, at least one second lens having a second optical characteristic different from the first optical characteristic. Activation of the first group and deactivation of the second group may produce a first light intensity distribution through the at least one first lens. Activation of the second group and deactivation of the first group may produce a second light intensity distribution different from the first light intensity distribution, through the at least one second lens. Each first lens may be associated with a single light-emitting element, and/or each second lens may be associated with a single light-emitting element.

The light-emitting strings (and/or the individual light-emitting elements) may not be individually dimmable, and the overall output of the array may be regulated only by the selective activation or deactivation of various ones of the light-emitting strings. The controller may selectively activate or deactivate various ones of the light-emitting strings in a pattern. The pattern may be activation or deactivation of one or more discrete rows of the strings, or individual elements within rows in a pattern that may be random or fixed, e.g., to minimize perceptibility. At least one (or even all) of the light-emitting elements may be light-emitting diodes. At least some of the light-emitting strings may have light-emitting elements that emit light having a chromaticity different from the chromaticity of light emitted by at least some other light-emitting strings. Each string may have elements emitting at a single chromaticity or may have elements emitting at different wavelengths to produce an aggregate string chromaticity.

One or more (or even all) of the power source(s) may be a constant voltage source or a constant current source. The constant current source may include at least one electronic component (for example, an active device (e.g., a transistor) or a passive device (e.g., a resistor)) for providing a stable current to the light-emitting elements. Each light-emitting string may be associated with (e.g., electrically connected to and powered by) a different power source. An activation system may regulate the controller, and the activation system may include at least one clock or timer and/or at least one sensor to detect an environmental condition. The controller may selectively activate or deactivate various ones of the light-emitting strings in response to the environmental condition. The sensor may be an occupancy sensor, a thermal sensor, an ambient light sensor, a smoke sensor, and/or a fire sensor. The activation system may be responsive to an external command source, e.g., a wired or wireless user remote control or a secondary controller, such as a central building controller, central fire or smoke detection system, etc. The clock or timer may be used to set a specific time or times of the day for activating and/or deactivating strings or to incorporate delays so that the system responds to other changes in environmental conditions, for example, room occupancy conditions, only after a predetermined delay time has elapsed. Communication between the activation system and the controller may be wired, wireless, optical or by other means.

In some embodiments, the pattern of activation and deactivation is a dynamic temporal pattern, while in other embodiments, the pattern is a static spatial pattern. In some implementations, the controller activates or deactivates the strings at a rate sufficient to make the dynamic temporal pattern visually imperceptible, whereas in other implementations, the strings are sequentially activated and deactivated at a rate to provide a perceptible pattern. Whereas PWM and related methods vary the luminous flux output of the system in a strictly temporal manner, embodiments of the present invention may vary the luminous flux output in a spatiotemporal manner as suited to a particular application.

The system may also include multiple switches, each associated with one of the light-emitting strings and controlling supply of power thereto from at least one power source. The switches, for example, may be electrically operated single-pole single-throw switches, or transistors. The system may include multiple shift registers for receiving signals from the controller and outputting the signals to the switches, and may also include, e.g., a data bus connecting the shift registers to the controller. The shift registers may have inputs connected in parallel to the controller, whereby data transmitted on the data bus shifts into and out of each register simultaneously with a plurality of latch signals each associated with a shift register. The shift registers may be connected in series with each other, whereby data transmitted on the data bus shifts into and out of each register sequentially with a single common latch signal provided substantially simultaneously to all of the shift registers. The shift registers may be, e.g., electronic D-type flip-flops.

In another aspect, embodiments of the invention feature a method for controlling a light-emitting array including or consisting essentially of a plurality of light-emitting strings, each string including or consisting essentially of a plurality of light-emitting elements electrically connected together, e.g., in series. Various ones of the light-emitting strings are selectively activated or deactivated to regulate an overall output of the array.

Embodiments of the invention may include one or more of the following in any of a variety of combinations. The light-emitting array may include or consist essentially of (i) a first group of one or more light-emitting strings, and, associated therewith, at least one first lens having a first optical characteristic, and/or (ii) a second group of one or more light-emitting strings, and, associated therewith, at least one second lens having a second optical characteristic different from the first optical characteristic. The first group may be activated and the second group may be deactivated to produce a first light intensity distribution through the at least one first lens. The second group may be activated and the first group may be deactivated to produce a second light intensity distribution different from the first light intensity distribution, through the at least one second lens. The light-emitting strings may not be individually dimmable, and the overall output of the array may be regulated only by the selective activation or deactivation of various ones of the light-emitting strings. Each first lens may be associated with a single light-emitting element, and/or each second lens may be associated with a single light-emitting element.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. As used herein, the terms "substantially" and "approximately" mean ±10%, and in some embodiments, ±5%. As used herein, the terms "pattern" and "geometric pattern" refer to a geometric arrangement, which may be random, pseudo-random, or regularly or semi-regularly repeating. As used herein, the term "phosphor" refers to any material that shifts the wavelength of light striking it and/or that is luminescent, fluorescent, and/or phosphorescent.

BRIEF DESCRIPTION OF THE DRAWINGS

In the drawings, like reference characters generally refer to the same parts throughout the different views. Also, the drawings are not necessarily to scale, with an emphasis instead generally being placed upon illustrating the principles of the invention. In the following description, various embodiments of the present invention are described with reference to the following drawings, in which.

DETAILED DESCRIPTION

Figure 1:
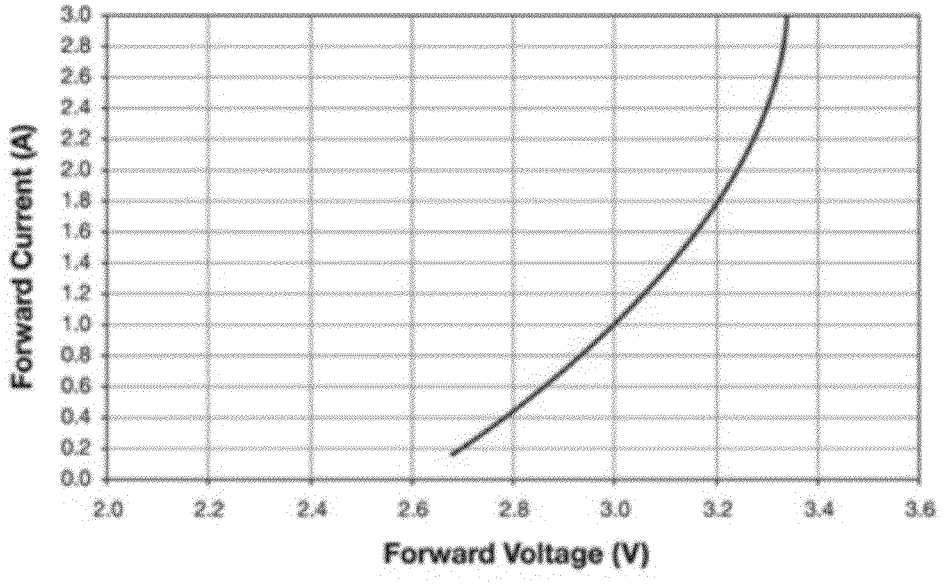
FIG. 1 shows a representative current voltage (I-V) curve for an LED.
Figure 2:
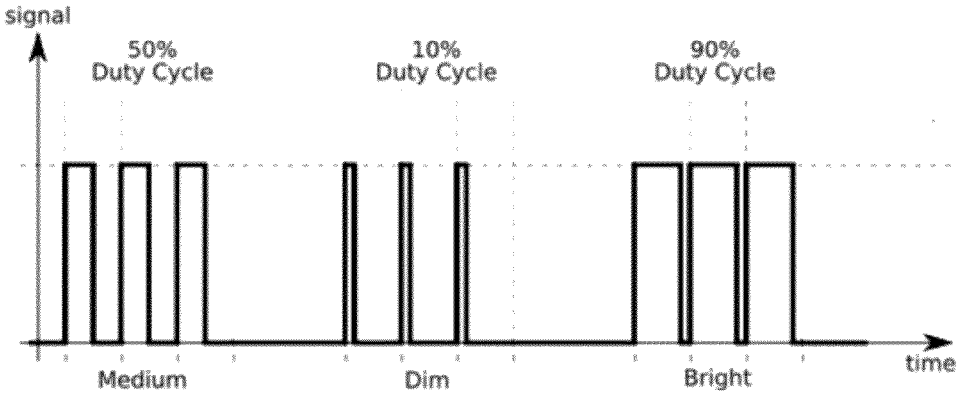
FIG. 2 schematically depicts pulse width modulation, at three different modulation levels.
Figure 3:
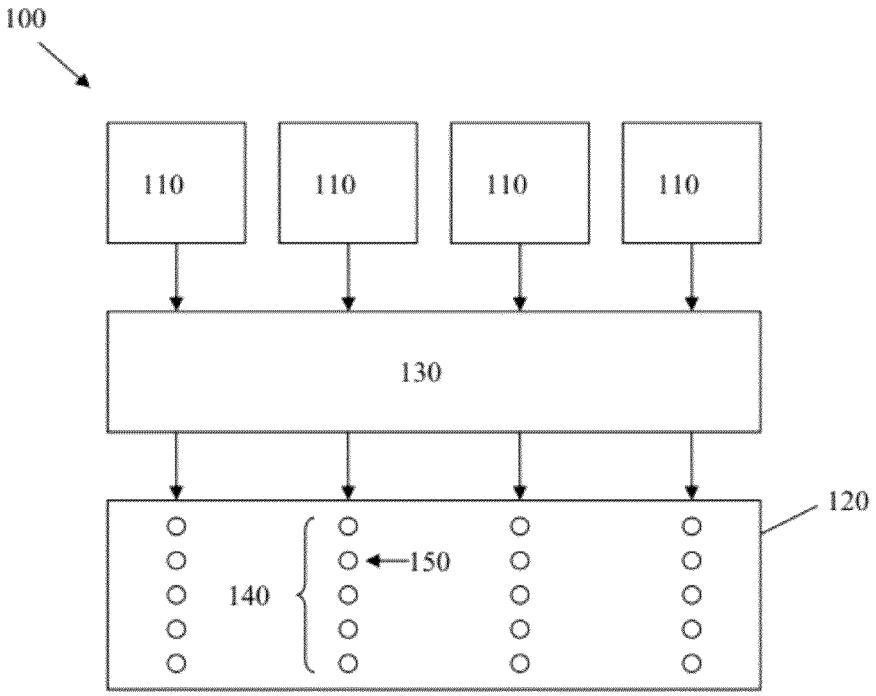
FIG. 3 schematically depicts circuitry of an illumination system utilizing a controller to achieve various lighting patterns of the light-emitting system in accordance with various embodiments of the invention.

FIG. 3 depicts an exemplary light-emitting system 100 in accordance with embodiments of the present invention, although alternative systems with similar functionality are also within the scope of the invention. As depicted, light-emitting system 100 includes at least one power source (e.g., a constant voltage source or a constant current source) 110 to provide power to a light-emitting array 120 via the controller 130. The light-emitting array 120 comprises multiple light emitting strings 140; each string contains multiple light-emitting elements 150. In some embodiments, the light-emitting elements 150 of each light-emitting string 140 are electrically connected in series, and the strings are electrically connected in parallel.

As used herein, the term "string" means a combination of one or more LEEs electrically connected in series, in parallel, or in a series-parallel combination with optional fuses, anti-fuses, current-limiting resistors, zener diodes, transistors, and other electronic components to protect the LEEs from electrical fault conditions and limit or control the current flow through individual LEEs or electrically-connected combinations thereof. In general, these combinations serve as an electrical "string" that has at least two electrical connections for the application of DC or AC power. A string may also include or consist essentially of a combination of one or more LEEs electrically connected in series, in parallel, or in a series-parallel combination of LEEs without additional electronic components.

As used herein, the term "light-emitting element" (LEE) means any device that emits electromagnetic radiation within a wavelength regime of interest, for example, visible, infrared or ultraviolet regime, when activated, by applying a potential difference across the device or passing a current through the device. Examples of LEEs include solid-state, organic, polymer, phosphor-coated or high-flux light-emitting diodes (LEDs), laser diodes or other similar devices as would be readily understood. The emitted radiation of an LEE may be visible, such as red, blue or green, or invisible, such as infrared or ultraviolet. An LEE may produce radiation of a spread of wavelengths. An LEE may include a phosphorescent or fluorescent material for converting a portion of its emissions from one set of wavelengths to another. The term LEE includes arrangements involving multiple individual LEEs, each emitting essentially the same or different wavelengths. The elements 150 may be solid-state LEDs, organic LEDs, polymer LEDs, phosphor coated LEDs, high-flux LEDs, micro-LEDs, laser diodes, or other similar devices as would be readily understood by a person of ordinary skill in the art; the elements may or may not be substantially identical.

Each light-emitting string 140 may be supplied by an independent power source 110 or a group of the strings may share one power source 110. The power source 110 may be a constant voltage source or a constant current source including at least one electronic component (e.g., an active device or a passive device) for providing a steady voltage or current to the light-emitting elements 150. For example, a constant voltage source may be DC batteries which are capable of providing a sufficiently high DC voltage to turn on the LEDs, and a constant current source may simply include a transistor or a resistor to provide a controlled current through the light-emitting strings 140.

A lighting pattern may be generated by selective activation and/or deactivation, by the controller 130, of various light-emitting strings 140 connected thereto. The controller 130 may selectively activate or deactivate one or more strings in a pattern that may be random or fixed, e.g., to minimize perceptibility. In one embodiment of the present invention, the pattern is used to regulate the light intensity of the light-emitting system 100. For example, the emitted light of a system with 80% of the light-emitting strings 140 activated is typically brighter than that of a system with 50% of the strings 140 turned on (assuming that all of the strings 140 in light-emitting system 100 have substantially the same brightness per string, although this is not critical to the present invention and in other embodiments different strings have different brightness levels). Controlling the number of the light-emitting strings activated at a given time may thus regulate the dimming pattern of the system.

The light-emitting elements may generate radiation with a spread of wavelengths. The output radiation may be visible (e.g., red, blue, yellow, or green light) or invisible (e.g., infrared or ultraviolet light). In one embodiment, each light-emitting string has light-emitting elements emitting at a single chromaticity or has elements emitting at different wavelengths to produce an aggregate string chromaticity. Activating or deactivating of various strings may thus generate a different chromaticity pattern. Individual phosphors may be applied on the light-emitting elements for converting part of their output from one wavelength to another. In some embodiments, each string contains a single type of phosphor and LED and therefore outputs at a single chromaticity. Switching strings with different chromaticities on and off may thus provide a combined mixed light output. The chromaticity of the combined mixed light output may be easily adjusted/shifted by switching different numbers of strings, each emitting a single chromaticity of light, on and off. A desired chromaticity pattern of the light-emitting system may thus be achieved. In other embodiments each string contains different types of LEDs and the same phosphor, different types of phosphor and the same type of LEDs or different types of phosphors and different types of LEDs, or just different types of LEDs, for example red-, green- and blue-emitting LEDs.

The approach described herein is particularly suitable for relatively large arrays of LEEs with large numbers of strings of LEEs. Large numbers of LEEs permit averaging or homogenization of electrical and/or optical properties. The manufacturing process of, for example, semiconductor LEDs yields devices with a range of forward voltages, luminous efficacies (lumens per watt), and dominant wavelength (a measure of chromaticity). By utilizing many devices, the strings 140 may be designed to control the light-emitting elements 150 based on the average electrical and optical characteristics of the devices in each string, rather than the worst-case values for a few devices. For example, individual light-emitting elements within a string or an illumination system may have a range of properties that, taken together, are substantially invisible or do not substantially affect the performance of the illumination system, whereas in a system with relatively fewer light-emitting elements, such variations are visible or unacceptably large. For example, where the light-emitting elements are LEDs, the manufacturing process may produce LEDs with a range of forward voltages. In a series-connected string, the average forward voltage is the string voltage (i.e., the sum of the forward voltages of all of the LEDs in the string) divided by the number of LEDs in the string. Thus, at the string level, the voltage is an average of the distribution within the string. In an illumination system with only one or a few LEDs, the total LED voltage might have a relatively larger and undesirable variation between illumination systems made with these LEDs. In some embodiments, arrays in accordance herewith may include or consist essentially of more than about 100 light-emitting elements. In some embodiments such arrays include or consist essentially of more than about 1000 or more than about 3000 light-emitting elements. Given a sufficient number of strings, the instantaneous change in aggregate luminous flux output as one string is energized or de-energized may be acceptable or even imperceptible to a person viewing the space illuminated by the system. By successively energizing and de-energizing strings over time, the system provides dimming capabilities. Thus, the light-emitting strings (and/or the LEEs within them) may not be, and typically are not, themselves individually dimmable. Rather, dimming and/or other lighting effects are typically achieved by selective activation and/or deactivation of one or more strings, as described above. Thus, the illumination system may lack drivers or other circuitry enabling string and/or LEE dimming, thereby simplifying the design and rendering the system less expensive.

One advantage of various embodiments of the invention is that each string provides a constant and fixed drive current to each LEE. As such, the system power supply may be designed to provide maximum conversion efficiency and high power factor. Undesirable chromaticity shifts and uneven LEE luminous flux outputs associated with low drive currents may also be reduced or eliminated.

Another advantage of embodiments of the present invention is that the strings are energizing and de-energizing only once during a change in luminous flux output. Moreover, the change in load to the power supply is minimal. This greatly alleviates the possibility of electrical interference being generated and transmitted via the AC power line or as radio-frequency emissions. (By comparison, the load to the power supply to a PWM controller switches from zero to full power with every pulse of the PWM signal.)

Yet another advantage of embodiments of the invention is that it is easier to interface to a phase-cut dimming control when compared to conventional digital-dimming methods. In particular, any electrical noise present on the input from the dimming control at low dimming levels may be easily dealt with using signal averaging techniques.

Finally, a large number of strings permits very fine control over the dimming capability or light target level. In some embodiments, the number of strings is greater than 10, greater than 50, or greater than 100. Therefore, the number of discrete dimming levels (and, hence, the dimming resolution), as well as the number and complexity of patterns which may be created, is much greater than with a small array or an array with a small number of separately switchable strings. Likewise, larger arrays with more switchable strings allow for finer control over other lighting parameters such as chromaticity and luminous flux distribution.

Figure 4:
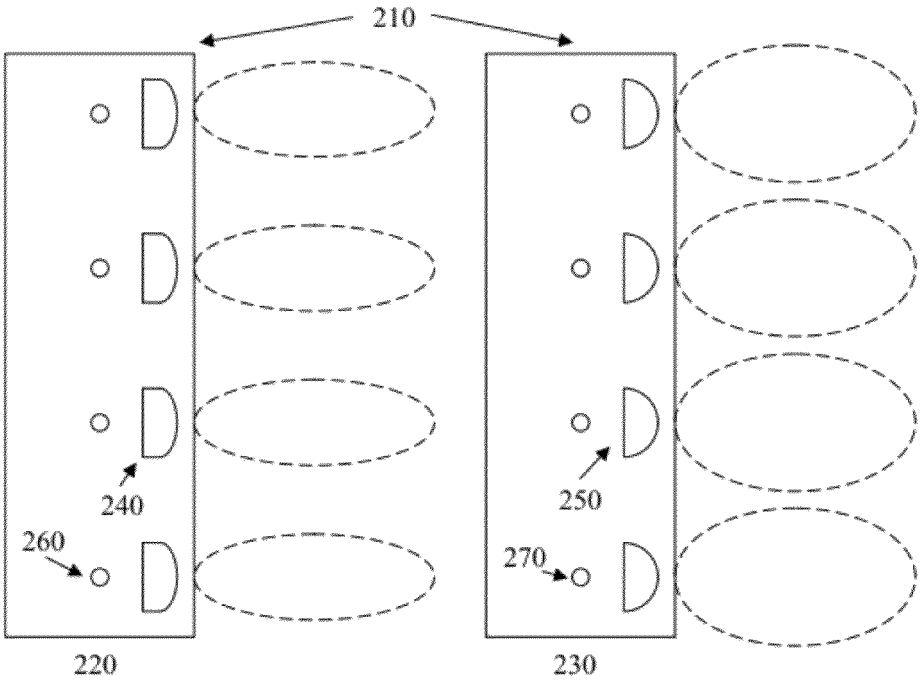
FIG. 4 depicts a lenslet array featuring a plurality of lenses integrated with light-emitting elements in accordance with various embodiments of the invention.

Referring to FIG. 4, in some embodiments, an array of lenses 210 featuring a plurality of lens strings 220, 230 is employed. Each string 220, 230 contains multiple lenses 240, 250 and is associated with a string of light-emitting elements 260, 270. (Although for purposes of illustration the LEEs and lenses are shown in profile, in typical implementations they are all on the same system (e.g., a luminaire) and emit light, for example, in a direction perpendicular to a common substrate.) Each lens may have individual optical characteristics and thus generate different light intensity distributions of the light-emitting elements. In one embodiment, each light-emitting string is associated with lenses of identical optical characteristics, and different light-emitting strings are coupled to lenses with the same or different optical characteristics. For example, as illustrated in FIG. 4, the lens string 220 generates a narrow light intensity distribution whereas the lens string 230 generates a broad distribution. The light intensity distribution of the light-emitting system may thereby be modified between a broad distribution and a narrow distribution by selectively activating or deactivating (in string-wise fashion) light-emitting elements 260 and 270 associated with the different lens types. This application may be useful, for example, for luminaires that normally provide a broad area distribution for office lighting, but may need to provide a narrow distribution to illuminate emergency egress routes while consuming minimal power provided by an emergency generator. Other physical configurations of the lens array are possible; for example, different strings of lenses may produce a symmetric or an asymmetric light intensity distribution. In this configuration, a single luminaire design may provide broad distribution for office lighting while optionally providing an asymmetric distribution for luminaires located near office walls. In some embodiments, a single lens is associated with an LEE, a string of LEEs, or even multiple strings.

Figure 5A:
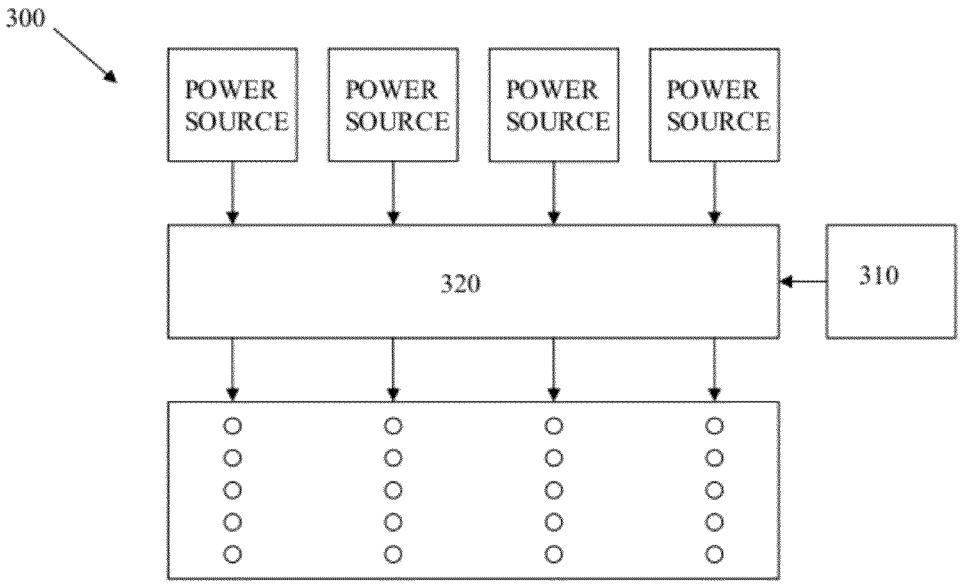
FIG. 5A schematically illustrates a controller of a light-emitting system regulated by an activation system in accordance with various embodiments of the invention.

So far, we have shown that the dimming pattern, chromaticity pattern, and the pattern of the light intensity distribution may be regulated via the controller activating or deactivating the light-emitting strings. The overall lighting patterns may be a dynamic temporal pattern or a static spatial pattern. The switching rate between activation and deactivation may be well controlled such that the patterns may be visually perceptible or imperceptible. With reference to FIG. 5A, the light-emitting system 300 may incorporate an activation system 310 to regulate the controller 320, which itself activates and deactivates various of the LED strings in order to achieve a desired lighting effect. In one embodiment, the activation system is a timer. In another embodiment, the activation system features a sensor to detect an environmental condition, and the controller sets a pattern in response thereto. For example, upon detecting the light intensity of light in an office at twilight, the sensor may transmit a signal to the controller, triggering activation of a larger number of light-emitting strings for increasing the brightness in the office. This process may be repeated until a targeted value of brightness is achieved, and may continue over time as the ambient light diminishes. Selective activation and deactivation may be static in the sense that a number of strings appropriate to the sensed condition remains persistently active and the rest are inactive, or may be dynamic in the sense that all strings are active but are selectively (and typically imperceptibly) turned on and off, with greater off times corresponding to lower overall light output. The detecting sensor may be, for example, an occupancy sensor, a thermal sensor, an ambient light sensor, a smoke sensor, or a fire sensor.

Figure 5B:
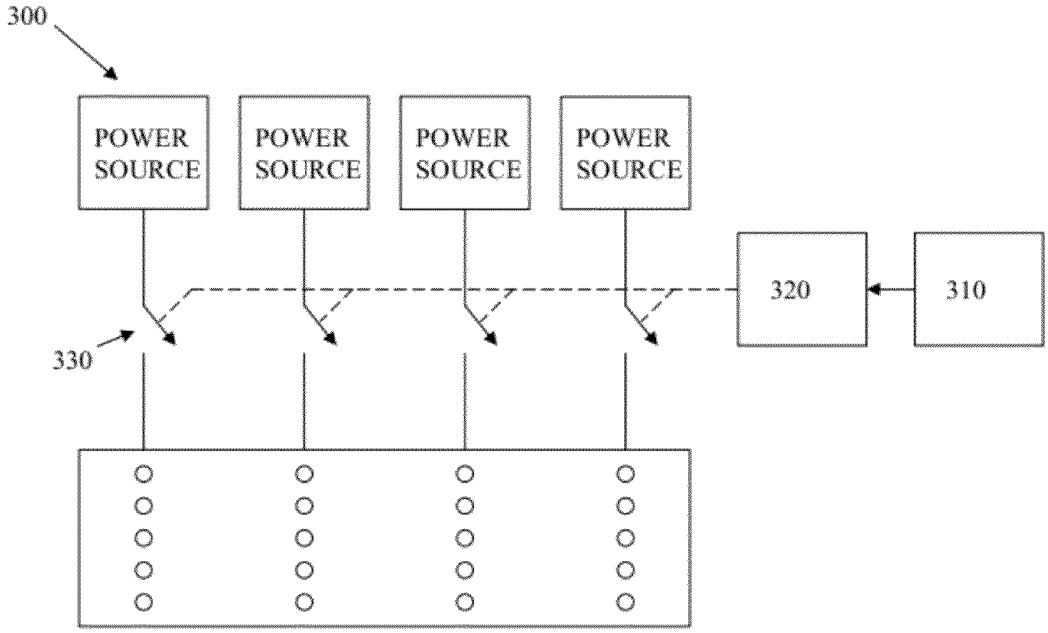
FIG. 5B schematically illustrates a controller regulating a pattern of the light-emitting strings through multiple switches in accordance with various embodiments of the invention.

In one embodiment, the activation system is responsive to an external command source, e.g., a user remote control unit that transmits user commands. The remote control unit may be linked to the controller via a wired or wireless network. In another embodiment, the external command source is a secondary controller, such as a central building controller, central fire or smoke detection system, etc. In various embodiments, the light-emitting system also includes multiple switches 330, as depicted in FIG. 5B. Each switch may be associated with one of the light-emitting strings and receive a command from the controller to activate or deactivate the string. The switch may be, for example, an electrically-operated single pole single throw type switch or a transistor.

The controller may be provided as either software, hardware, or some combination thereof. A typical implementation utilizes a common programmable microcontroller or application-specific integrated circuit (ASIC) programmed as described above. However, the system may also be implemented on more powerful computational devices, such as a PC having a CPU board containing one or more processors. The controller may include a main memory unit for storing programs and/or data relating to the activation or deactivation described above. The memory may include random access memory (RAM), read only memory (ROM), and/or FLASH memory residing on commonly available hardware such as one or more ASICs, field programmable gate arrays (FPGA), electrically erasable programmable read-only memories (EEPROM), programmable read-only memories (PROM), or programmable logic devices (PLD). In some embodiments, the programs may be provided using external RAM and/or ROM such as optical disks, magnetic disks, as well as other commonly used storage devices.

For embodiments in which the controller is provided as a software program, the program may be written in any one of a number of high level languages such as FORTRAN, PASCAL, JAVA, C, C++, C#, LISP, PERL, BASIC, PYTHON or any suitable programming language.

Figure 6:
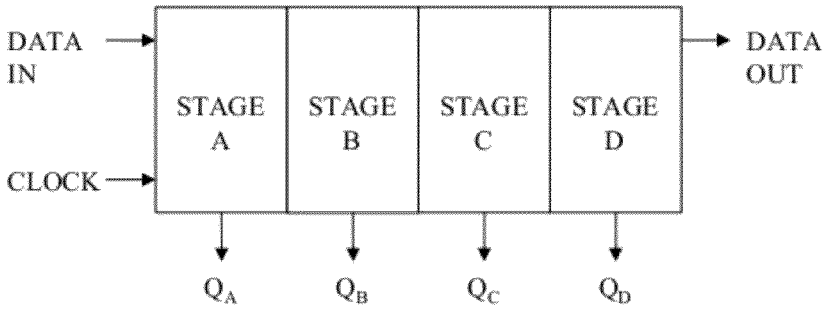
FIG. 6 schematically depicts a four-stage shift register delaying "data in" by four clock cycles to "data out" in accordance with various embodiments of the invention.

In some embodiments of the invention, the controller does not contain enough output pins to accommodate all of the light-emitting strings. Using shift registers may allow the controller to regulate a large number of strings with a few output pins, as well as reducing the amount of wiring in the circuit of the light-emitting system. A shift register produces a discrete delay of a digital signal synchronized to a clock; the signal is delayed by "n" discrete clock cycles, where "n" is the number of shift register stages. FIG. 6 depicts a four-stage shift register delaying "data in" by four clock cycles with respect to "data out." Data is shifted into internal storage elements and shifted out at the data-out pin. The shift register makes all the internal stages available as outputs. Therefore, if four data bits are shifted in by four clock pulses via a single wire at data-in, as depicted in FIG. 4, the data becomes available simultaneously on the four outputs $Q_A$, $Q_B$, $Q_C$, and $Q_D$ after the forth clock pulse. This shift register may be used to convert data from a single source (e.g., the controller) to parallel format on multiple devices (e.g., the light-emitting strings). The shift register may be utilized to increase the number of outputs of a controller.

Figure 7:
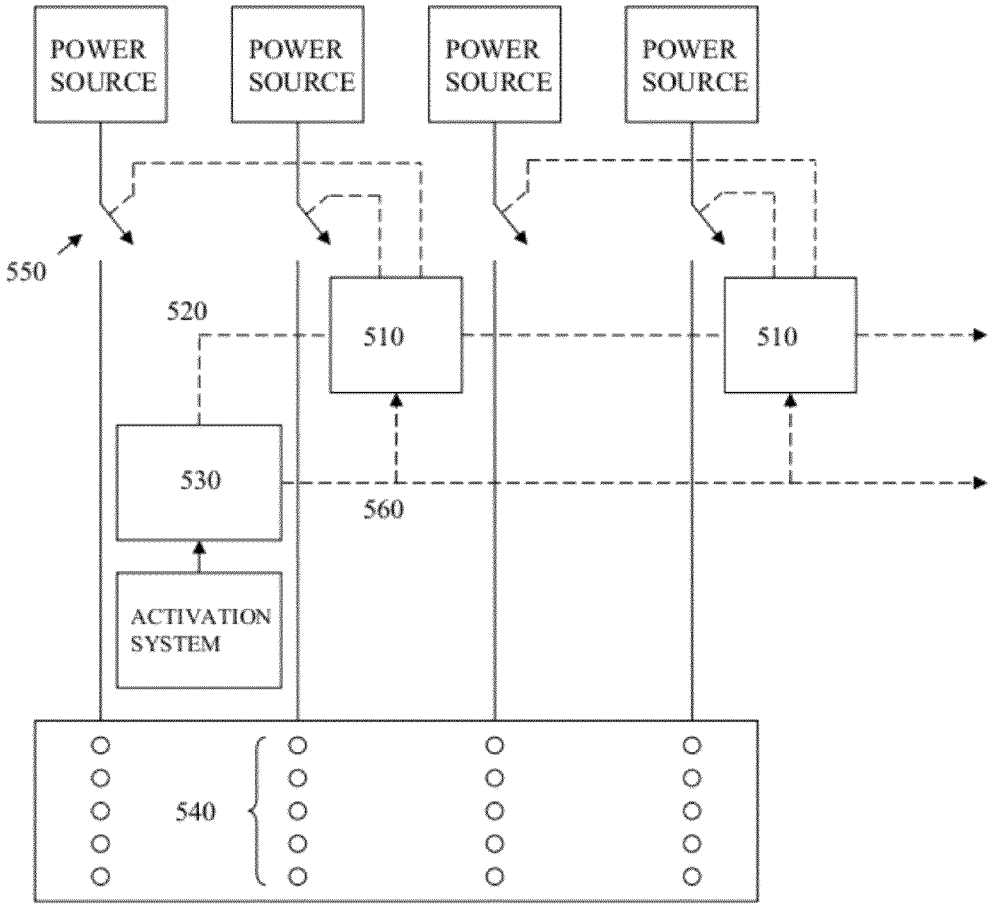
FIG. 7 schematically illustrates multiple shift registers integrated with a light-emitting system via a data bus, where the shift registers are connected in series with a controller, in accordance with various embodiments of the invention.

FIG. 7 depicts multiple shift registers 510 integrated with a light-emitting system via a data bus 520 or other suitable interconnection scheme; a controller 530 with a limited number of pins may thus regulate the activation or deactivation of multiple light-emitting strings 540 through the shift registers 510. Each output of the internal stages of the register 510 may connect to a light-emitting string 540 via an associated switch 550; a single latch signal bus 560 connected in parallel with all the shift registers 510 is commonly linked to the controller 530. The shift registers 510 are connected in series with each other. Data sent from the controller 530 for activating or deactivating the light-emitting strings 540 are transmitted on the data bus 520 and shift into each shift register 510 sequentially. Data in each shift register 510 may then be simultaneously transmitted to the light-emitting strings 540 after the nth clock pulse, where n is the number of light-emitting strings 540 connected to each shift register 510. Data shifting out of each shift register 510 with a single common latch signal on the latch signal bus 560 is provided substantially simultaneously to all of the shift registers 510. The controller in this circuit design may then control multiple light-emitting strings through a few shift registers; this approach accommodates situations where the output pins of the controller are limited and also reduces costs of wiring the system.

Figure 8:
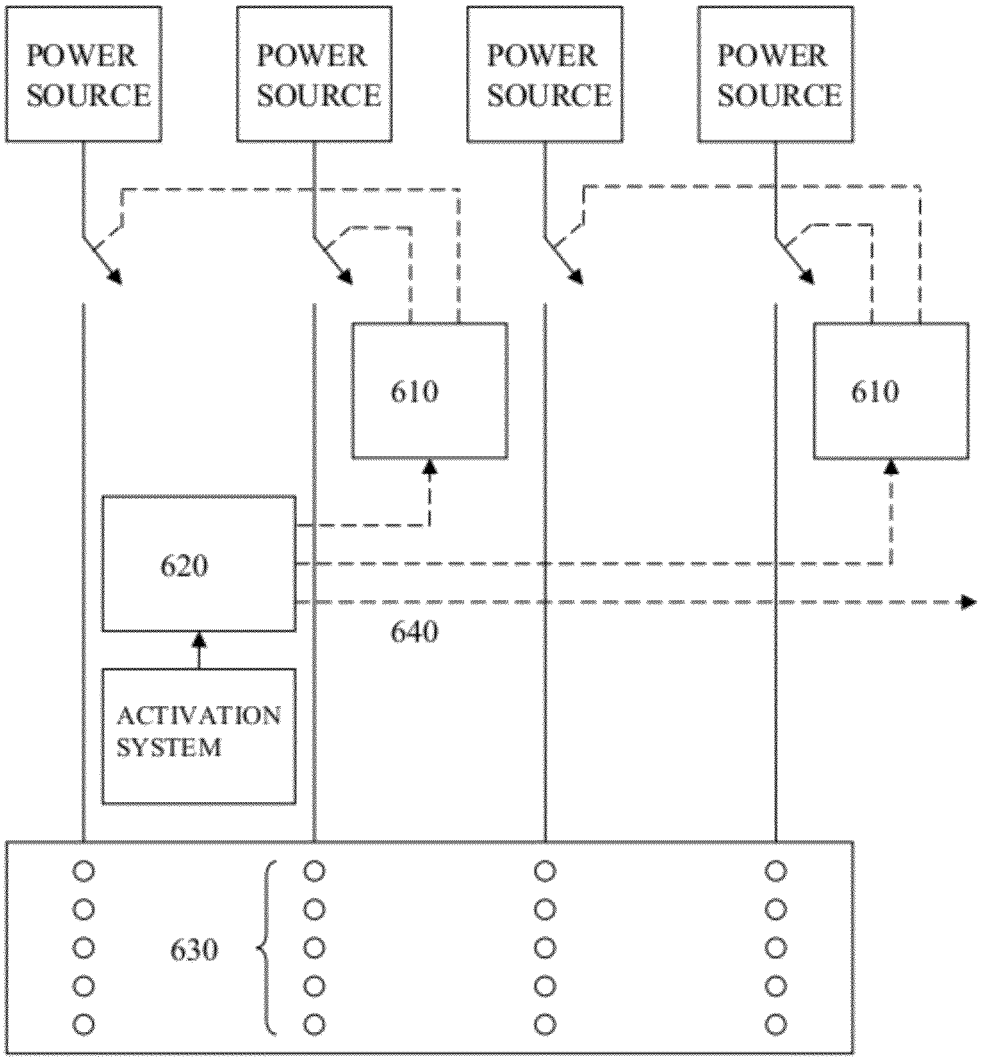
FIG. 8 schematically illustrates multiple shift registers integrated with a light-emitting system via a data bus, where the inputs of the shift registers are connected in parallel with a controller, in accordance with various embodiments of the invention.

Referring to FIG. 8, in some embodiments, the inputs of the shift registers 610 are connected in parallel to the controller 620 such that data sent from the controller may shift into each shift register 610 simultaneously. This circuitry design allows the controller 620 to regulate the activation or deactivation of groups of light-emitting strings 630, each associated with a shift register 610, simultaneously. The shift registers 610 thus permit the controller to regulate all light-emitting strings simultaneously and generate a desired light pattern accordingly. Thus, the shift registers are used as latches: data is loaded in serially, but simultaneously to each shift register since they are connected to the data bus in parallel, and is then latched in using dedicate latching signals for each register.

Figure 9:
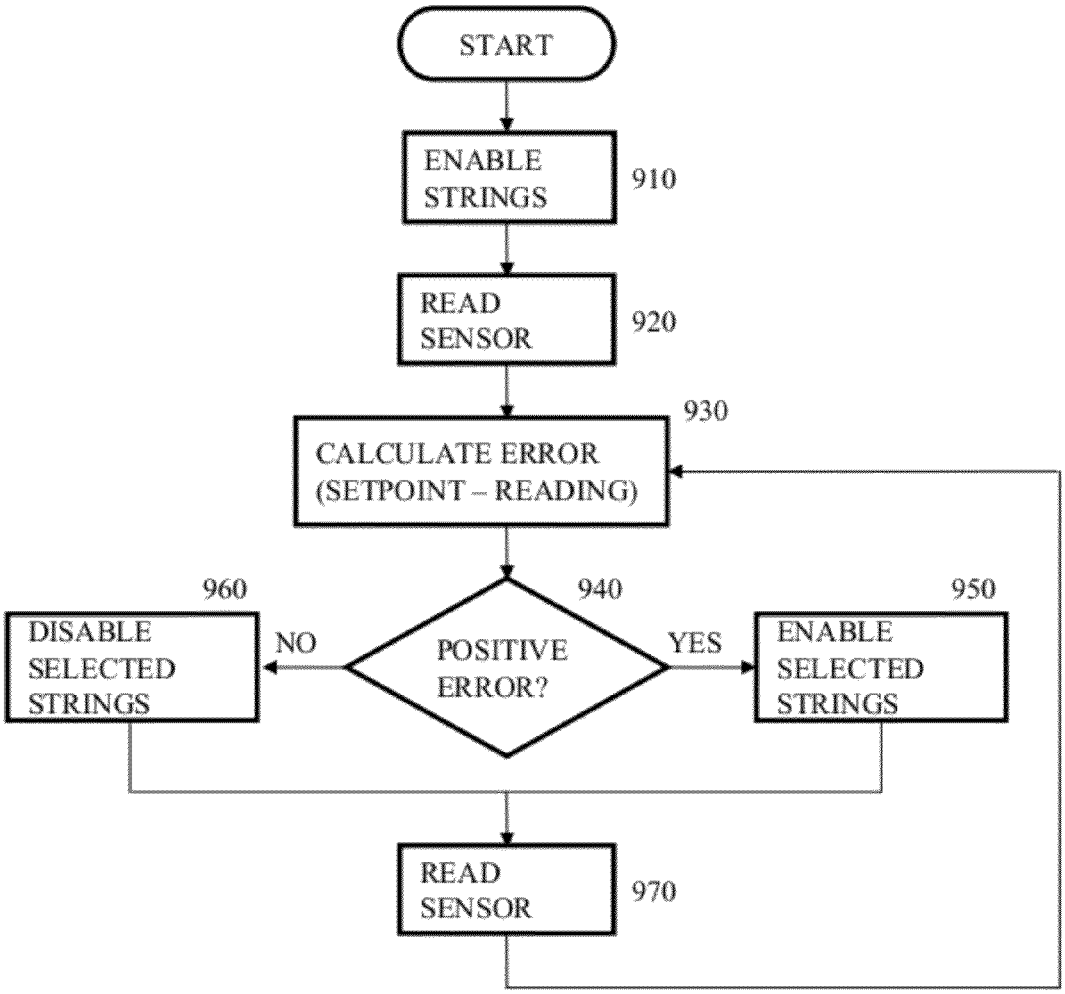
FIG. 9 is a flowchart depicting an illumination method in accordance with various embodiments of the invention.

FIG. 9 depicts a flowchart of an exemplary illumination method in accordance with various embodiments of the invention. With additional reference to FIG. 5A, in step 910 of FIG. 9, some or all of the LEE strings are enabled by controller 320. In step 920, one or more light sensors (e.g., within activation system 310) are utilized to determine the ambient light level, which may include or consist essentially of a level of sunlight. In step 930, an "error" is calculated as the difference between a predetermined setpoint and the sensor measurement. In an embodiment, if the ambient light level is greater than the setpoint, the error is positive; otherwise it is negative. As shown in steps 950 and 960, depending on the error level, selected strings are either enabled to increase the light output from the system (step 950) or disabled to decrease the light output from the system (step 960). Following either of these steps, the one or more light sensors are again read to determine the new ambient light level (step 970) before control is returned to step 930.

Figure 10A:
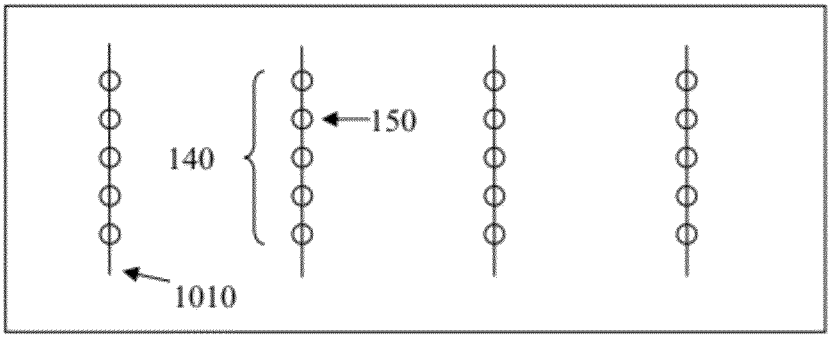
FIGS. 10A and 10B are schematic plan views of illumination systems having different electrical-interconnection schemes in accordance with various embodiments of the invention.
Figure 10B:
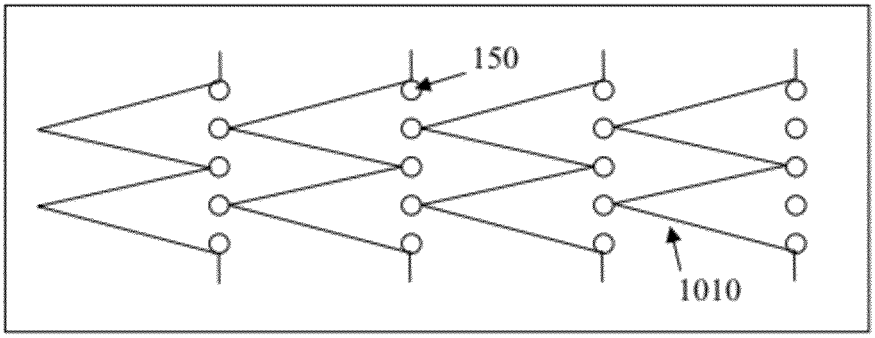

In FIGS. 3, 5A, 5B, 7 and 8, the LEEs in each string are shown as having a linear physical layout, that is the LEE in each string form a straight line. This results in a pattern of lines of LEEs that may be energized or de-energized, as described herein. However, this is not a limitation of the present invention and in other embodiments the physical layout of the LEEs does not match the physical layout of the interconnection of the LEEs. For example, in FIG. 10A, LEEs 150 are electrically coupled in strings 140 by electrical connector 1010 in a layout such that the physical layout of electrical connector 1010 matches the physical layout of LEEs 150. FIG. 10B shows an example where this is not the case. In FIG. 10B, electrical connectors 1010 each form a string of LEEs 150; however, the individual LEEs interconnected in a string are positioned in two adjacent physical "lines" of LEEs. Such arrangements may be used to change the pattern of light generated when one or more strings are energized or de-energized, for example, to make a more diffuse arrangement of a dimming pattern. This layout is not a limitation of the present invention and in other embodiments any different layout and interconnection of the LEEs and the LEEs within a string are employed. Embodiments of the invention may utilize various layouts and/or other techniques to minimize the visible impact of string energizing and de-energizing (and/or partial or full string failure) described in U.S. patent application Ser. No. 13/183,684, filed Jul. 15, 2011, the entire disclosure of which is incorporated by reference herein.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. An illumination system comprising:

a light-emitting array comprising a plurality of light-emitting strings, each light-emitting string comprising a plurality of light-emitting elements electrically connected in series;

a plurality of constant current sources, each constant current source providing a constant current to a different one of the light-emitting strings;

a power supply for supplying power to the plurality of constant current sources; and a controller for selectively activating or deactivating various ones of the light-emitting strings to regulate an overall output of the array, wherein (i) the light-emitting strings are not individually dimmable by the controller, and the light output of the light-emitting strings is regulated only by the selective activation or deactivation of various ones of the light-emitting strings, (ii) the light-emitting array comprises a first group of one or more light-emitting strings and, associated therewith, at least one first lens having a first optical characteristic, (iii) the light-emitting array comprises a second group, different from the first group, of one or more light-emitting strings and, associated therewith, at least one second lens having a second optical characteristic, (iv) activation of the first group and deactivation of the second group produces a first light intensity distribution through the at least one first lens, and (v) activation of the second group and deactivation of the first group produces a second light intensity distribution different from the first light intensity distribution, through the at least one second lens.

2. The illumination system of claim 1, wherein the controller selectively activates or deactivates various ones of the light-emitting strings in a pattern.

3. The illumination system of claim 1, wherein the light-emitting elements are light-emitting diodes.

4. The illumination system of claim 1, wherein at least some of the light-emitting strings have light-emitting elements that emit light having a chromaticity different from a chromaticity of light emitted by at least some other light-emitting strings.

5. The illumination system of claim 1, wherein each said at least one first lens is associated with a single light-emitting element.

6. The illumination system of claim 1, wherein each said at least one second lens is associated with a single light-emitting element.

7. The illumination system of claim 1, further comprising an activation system for regulating the controller.

8. The illumination system of claim 7, wherein the activation system comprises at least one sensor to detect an environmental condition, the controller selectively activating or deactivating various ones of the light-emitting strings in response thereto.

9. The illumination system of claim 8, wherein the sensor is at least one of an occupancy sensor, a thermal sensor, an ambient light sensor, a smoke sensor, or a fire sensor.

10. The illumination system of claim 7, wherein the activation system comprises at least one timer.

11. The illumination system of claim 7, wherein the activation system is responsive to an external command source.

12. The illumination system of claim 11, wherein the external command source is a user remote control.

13. The illumination system of claim 1, further comprising a plurality of switches, each switch being associated with one of the light-emitting strings and controlling supply of current thereto from one of the constant current sources.

14. An illumination system comprising:

a light-emitting array comprising a plurality of light-emitting strings, each light-emitting string comprising a plurality of light-emitting elements electrically connected in series;

at least one power source for providing power to the light-emitting strings;

a controller for selectively activating or deactivating various ones of the light-emitting strings to regulate an overall output of the array;

a plurality of switches, each switch being associated with one of the light-emitting strings and controlling supply of power thereto from at least one said power source; and a plurality of shift registers for receiving signals from the controller and outputting the signals to the switches.

15. The illumination system of claim 14, further comprising a data bus connecting the shift registers to the controller.

16. The illumination system of claim 15, wherein the shift registers have inputs connected in parallel to the controller, whereby data transmitted on the data bus shifts into and out of each register simultaneously with a plurality of latch signals each associated with a shift register.

17. The illumination system of claim 15, wherein the shift registers are connected in series with each other, whereby data transmitted on the data bus shifts into and out of each register sequentially with a single common latch signal provided substantially simultaneously to all of the shift registers.

18. The illumination system of claim 14, wherein the shift registers are electronic D-type flip-flops.

19. The illumination system of claim 14, wherein the light-emitting strings are not individually dimmable by the controller, and the light output of the light-emitting strings is regulated only by the selective activation or deactivation of various ones of the light-emitting strings.

20. The illumination system of claim 14, wherein the controller selectively activates or deactivates various ones of the light-emitting strings in a pattern.

21. The illumination system of claim 14, wherein the light-emitting elements are light-emitting diodes.

22. The illumination system of claim 14, wherein at least some of the light-emitting strings have light-emitting elements that emit light having a chromaticity different from a chromaticity of light emitted by at least some other light-emitting strings.

23. The illumination system of claim 14, wherein the light-emitting array comprises a first group of one or more light-emitting strings and, associated therewith, at least one first lens having a first optical characteristic.

24. The illumination system of claim 23, wherein each said at least one first lens is associated with a single light-emitting element.

25. The illumination system of claim 23, wherein:

the light-emitting array comprises a second group, different from the first group, of one or more light-emitting strings and, associated therewith, at least one second lens having a second optical characteristic, activation of the first group and deactivation of the second group produces a first light intensity distribution through the at least one first lens, and activation of the second group and deactivation of the first group produces a second light intensity distribution different from the first light intensity distribution, through the at least one second lens.

26. The illumination system of claim 25, wherein each said at least one second lens is associated with a single light-emitting element.

27. The illumination system of claim 14, wherein the at least one power source is a constant voltage source.

28. The illumination system of claim 14, wherein the at least one power source is a constant current source.

29. The illumination system of claim 28, wherein the constant current source comprises at least one electronic component for providing a stable current to the light-emitting elements.

30. The illumination system of claim 14, wherein the at least one power source comprises a plurality of power sources, and each light-emitting string is associated with a different power source.

31. The illumination system of claim 14, further comprising an activation system for regulating the controller.

32. The illumination system of claim 31, wherein the activation system comprises at least one sensor to detect an environmental condition, the controller selectively activating or deactivating various ones of the light-emitting strings in response thereto.

33. The illumination system of claim 32, wherein the sensor is at least one of an occupancy sensor, a thermal sensor, an ambient light sensor, a smoke sensor, or a fire sensor.

34. The illumination system of claim 31, wherein the activation system comprises at least one timer.

35. The illumination system of claim 31, wherein the activation system is responsive to an external command source.

36. The illumination system of claim 35, wherein the external command source is a user remote control.

37. A method for controlling a light-emitting array comprising a plurality of light-emitting strings, each light-emitting string comprising a plurality of light-emitting elements electrically connected in series, the method comprising:

providing a constant current to each of the light-emitting strings;

selectively activating or deactivating various ones of the light-emitting strings to regulate an overall output of the array, wherein (i) the light-emitting strings are not individually dimmable, and the light output of the light-emitting strings is regulated only by the selective activation or deactivation of various ones of the light-emitting strings, (ii) the light-emitting array comprises a first group of one or more light-emitting strings and, associated therewith, at least one first lens having a first optical characteristic, (iii) the light-emitting array comprises a second group, different from the first group, of one or more light-emitting strings and, associated therewith, at least one second lens having a second optical characteristic;

activating the first group and deactivating the second group to produce a first light intensity distribution through the at least one first lens; and activating the second group and deactivating the first group to produce a second light intensity distribution different from the first light intensity distribution, through the at least one second lens.

38. The method of claim 37, wherein each said at least one first lens is associated with a single light-emitting element.

39. The method of claim 37, wherein each said at least one second lens is associated with a single light-emitting element.

40. The method of claim 37, wherein constant current is provided to each of the light-emitting strings by a plurality of constant current sources, each constant current source providing a constant current to a different one of the light-emitting strings.

41. The method of claim 40, wherein power is supplied to the plurality of constant current sources from a constant voltage power supply.

42. The method of claim 40, wherein each constant current source comprises at least one resistor and at least one transistor.

43. An illumination system comprising:

a light-emitting array comprising a plurality of light-emitting strings, each light-emitting string comprising a plurality of light-emitting elements electrically connected in series;

a plurality of constant current sources, each constant current source providing a constant current to a different one of the light-emitting strings;

a power supply for supplying power to the plurality of constant current sources; and a controller for selectively activating or deactivating various ones of the light-emitting strings to regulate an overall output of the array, wherein the light-emitting strings are not individually dimmable by the controller, and the light output of the light-emitting strings is regulated only by the selective activation or deactivation of various ones of the light-emitting strings to produce a pattern of activated and deactivated light-emitting strings that is visibly perceptible to an observer of the illumination system.

44. The illumination system of claim 43, wherein the controller selectively activates or deactivates various ones of the light-emitting strings in a pattern.

45. The illumination system of claim 43, wherein the light-emitting elements are light-emitting diodes.

46. The illumination system of claim 43, wherein at least some of the light-emitting strings have light-emitting elements that emit light having a chromaticity different from a chromaticity of light emitted by at least some other light-emitting strings.

47. The illumination system of claim 43, wherein the light-emitting array comprises a first group of one or more light-emitting strings and, associated therewith, at least one first lens having a first optical characteristic.

48. The illumination system of claim 47, wherein each said at least one first lens is associated with a single light-emitting element.

49. The illumination system of claim 47, wherein:

the light-emitting array comprises a second group, different from the first group, of one or more light-emitting strings and, associated therewith, at least one second lens having a second optical characteristic, activation of the first group and deactivation of the second group produces a first light intensity distribution through the at least one first lens, and activation of the second group and deactivation of the first group produces a second light intensity distribution different from the first light intensity distribution, through the at least one second lens.

50. The illumination system of claim 49, wherein each said at least one second lens is associated with a single light-emitting element.

51. The illumination system of claim 43, further comprising an activation system for regulating the controller.

52. The illumination system of claim 51, wherein the activation system comprises at least one sensor to detect an environmental condition, the controller selectively activating or deactivating various ones of the light-emitting strings in response thereto.

53. The illumination system of claim 52, wherein the sensor is at least one of an occupancy sensor, a thermal sensor, an ambient light sensor, a smoke sensor, or a fire sensor.

54. The illumination system of claim 51, wherein the activation system comprises at least one timer.

55. The illumination system of claim 51, wherein the activation system is responsive to an external command source.

56. The illumination system of claim 55, wherein the external command source is a user remote control.

57. The illumination system of claim 43, further comprising a plurality of switches, each switch being associated with one of the light-emitting strings and controlling supply of current thereto from one of the constant current sources.

58. The illumination system of claim 43, wherein each constant current source comprises at least one resistor and at least one transistor.

* * * * *